US007082862B2

(12) United States Patent
Lee

(10) Patent No.: US 7,082,862 B2
(45) Date of Patent: Aug. 1, 2006

(54) HAND TOOL HAVING AN ADJUSTABLE HEAD

(76) Inventor: Li-Ju Lee, No. 145, Liaoyang 5 St., Peitun Dist., Taichung (TW)

( * ) Notice: Subject to any disclaimer, the term of this patent is extended or adjusted under 35 U.S.C. 154(b) by 164 days.

(21) Appl. No.: 10/865,806

(22) Filed: Jun. 14, 2004

(65) Prior Publication Data

US 2005/0274234 A1 Dec. 15, 2005

(51) Int. Cl.
*B25B 23/16* (2006.01)

(52) U.S. Cl. ..... 81/177.8; 81/177.7; 81/177.85

(58) Field of Classification Search ..... 81/177.8, 81/177.7, 177.89, 177.9
See application file for complete search history.

(56) References Cited

U.S. PATENT DOCUMENTS 6,216,567 B1 * 4/2001 Hu ..... 81/177.9
6,295,898 B1 * 10/2001 Hsieh ..... 81/177.8
6,386,075 B1 * 5/2002 Shiao ..... 81/177.8
6,745,650 B1 * 6/2004 Chang ..... 81/177.8
6,886,429 B1 * 5/2005 Lee ..... 81/177.8
6,895,839 B1 * 5/2005 Hsien ..... 81/177.8

* cited by examiner

*Primary Examiner*—Joseph J. Hail, III
*Assistant Examiner*—Alvin J. Grant
(74) *Attorney, Agent, or Firm*—Rosenberg, Klein & Lee

(57) ABSTRACT

A hand tool having an adjustable head includes a handle, a head and a head locking assembly. The handle has an elongated slot with a bottom. The head has a body that has a pivot junction pivotally mounted in the elongated slot and having an exterior toothed surface. The head locking assembly includes a sliding block, a rotatable locking assembly and a block biasing assembly. The sliding block is slidably mounted in the elongated slot between the pivot junction and the bottom of the elongated slot and includes an engaging device to engage the exterior toothed surface of the pivot junction. The rotatable locking assembly is rotatably mounted in the sliding block and includes a locking device such as an eccentric cam to abut the bottom of the elongated slot to restrict the sliding block in motion and lock the head at a given angular position.

15 Claims, 11 Drawing Sheets

HAND TOOL HAVING AN ADJUSTABLE HEAD

BACKGROUND OF THE INVENTION

1. Field of the Invention

The present invention relates to a hand tool, and more particularly to a ratchet hand tool with an adjustable head that utilizes a sliding block to position and lock the adjustable head at a given angle.

2. Description of Related Art

Hand tools, especially for ratchet socket wrenches are extensively used to tighten or loosen fasteners. With reference to FIG. 11, a conventional ratchet socket wrench in accordance with prior art comprises a head (50), a handle (60), a pivot pin (512) and a head positioning device (66). The head (50) is adjustably mounted on the handle (60) with the head positioning device (66) and comprises a head body (51) and a socket ratchet drive (52). The head body (51) is pivotally mounted on the handle (60) with the pivot pin (512) and has multiple detents (511) formed and arranged about the pivot pin (512). The socket ratchet drive (52) is mounted in the head body (51). The handle (60) has a ball hole (61) and a blind hole (63). The ball hole (61) is longitudinally defined in the handle (60) and is aligned selectively with the detents (511). The blind hole (63) is defined transversely in the handle (60) and communicates with the ball hole (61).

The head positioning device (66) is movably mounted in the holes (61, 63) and comprises an engaging ball (62), a stepped rod (64) and an inner spring (65). The engaging ball (62) is mounted in the ball hole (61). The stepped rod (64) is slidably mounted in the blind hole (63) with the inner spring (65) and has an exterior surface and an annular groove (641) defined in the exterior surface. The exterior surface of the stepped rod (64) abuts the engaging ball (62) in the ball hole (61) to urge the engaging ball (62) into one of the detents (511).

The stepped rod (64) can be pushed inward the blind hole (63) to align the annular groove (641) with the engaging ball (62), which will simultaneously compress the inner spring (65). The engaging ball (62) will slip into the annular groove (641) and disengage from the detent (511) so that the head (50) can be adjusted to a given angle relative to the handle (60).

The compressed inner spring (65) pushes the stepped rod (64) outward so as to urge the engaging ball (62) into one of the detents (511) by the exterior surface of the stepped rod (64) when the stepped rod (64) is released. Therefore, the engaging ball (62) that engages one of the detents (511) will position and lock the head (50) at the given angle relative to the handle (60).

However, the conventional ratchet hand tools still have some shortcomings when manufacturing and using the hand tools.

First, the conventional hand tools are neither easy nor quick to fabricate and assemble, especially assembling the head positioning device (66). The handle (60) needs to have the positions of the holes (61, 63) precisely defined because if they are not manufacturing yields of the tools will be low and manufacturing costs will be excessive. In addition, assembling the engaging ball (62), the inner spring (65) and the stepped rod (64) is inconvenient and slow.

Second, the head positioning device (66) of the conventional hand tools uses simply the engaging ball (62) to engage one detent (511), whereby the engaging effect between the engaging ball (62) and the detent (511) is weak and unreliable.

Third, since it is difficult to adjust the head (50) using only a single hand, the conventional hand tools are inconvenient to use. A person must use both hands, i.e., one hand holds the handle (60) and the other hand pushes the stepped rod (64) inward the blind hole (63) to adjust the head (50) because the stepped rod (64) always needs to be pressed to allow the head (50) being adjustable. Thus, one-handed operations for adjusting the head (50) of the conventional tools are difficult.

To overcome the shortcomings, the present invention provides an improved ratchet hand tool having a sliding block to position and lock a head at a given angle relative to a handle of the ratchet hand tool to mitigate or obviate the aforementioned problems.

SUMMARY OF THE INVENTION

The main objective of the invention is to provide a hand tool with an adjustable head, and the ratchet hand tool has a simple structure and permits one-handed operations for adjusting the head to achieve convenience of operation and economic manufacturing costs.

A hand tool having an adjustable head in accordance with the present invention includes a handle, a head and a head locking assembly. The handle has a distal end and an elongated slot with a bottom defined at the distal end. The head is adjustably mounted at the distal end of the handle and has a body. The body is pivotally mounted at the distal end and has a pivot junction. The pivot junction is pivotally mounted in the elongated slot and has an exterior toothed surface corresponding to the bottom of the elongated slot. The head locking assembly is used to position and lock the head at a given angular position and includes a sliding block, a rotatable locking assembly and a block biasing assembly. The sliding block is slidably mounted in the elongated slot between the pivot junction and the bottom of the elongated slot and includes an engaging device to engage the exterior toothed surface of the pivot junction. The rotatable locking assembly is rotatably mounted in the sliding block and includes a spindle rotatably mounted in the sliding block, a turning leaf attached to the spindle to rotate the spindle and a locking device as eccentric cams attached to the spindle. The block biasing assembly is mounted in the elongated slot between the sliding block and the bottom of the elongated slot whereby the turning leaf is turned by a single hand until the locking device abuts the bottom of the elongated slot to restrict the sliding block in motion and lock the head at the given angular position.

Other objectives, advantages and novel features of the invention will become more apparent from the following detailed description when taken in conjunction with the accompanying drawings.

DETAILED DESCRIPTION OF PREFERRED EMBODIMENT

Figure 1:
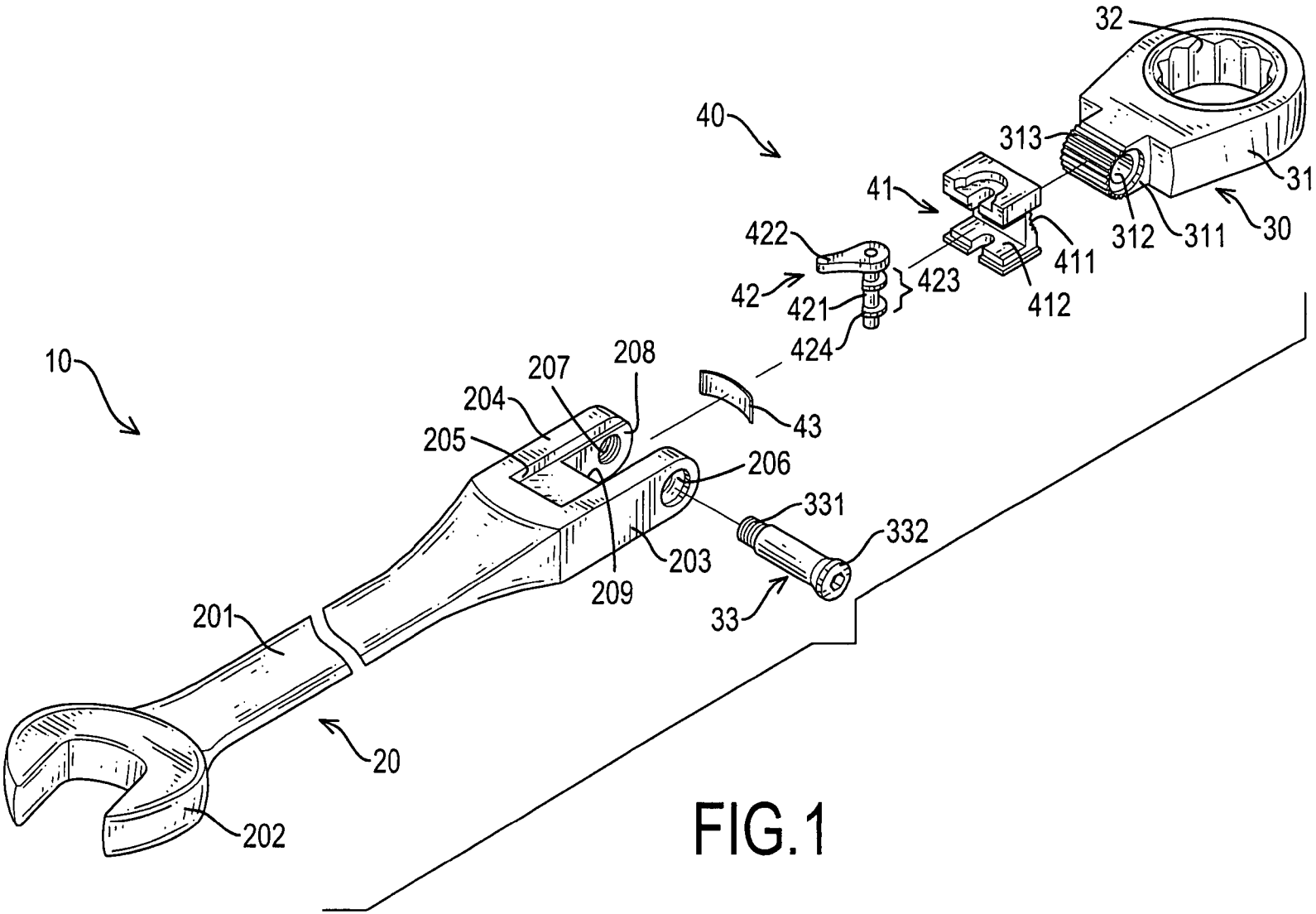
FIG. 1 is an exploded perspective view of a ratchet hand tool in accordance with the present invention.
Figure 2:
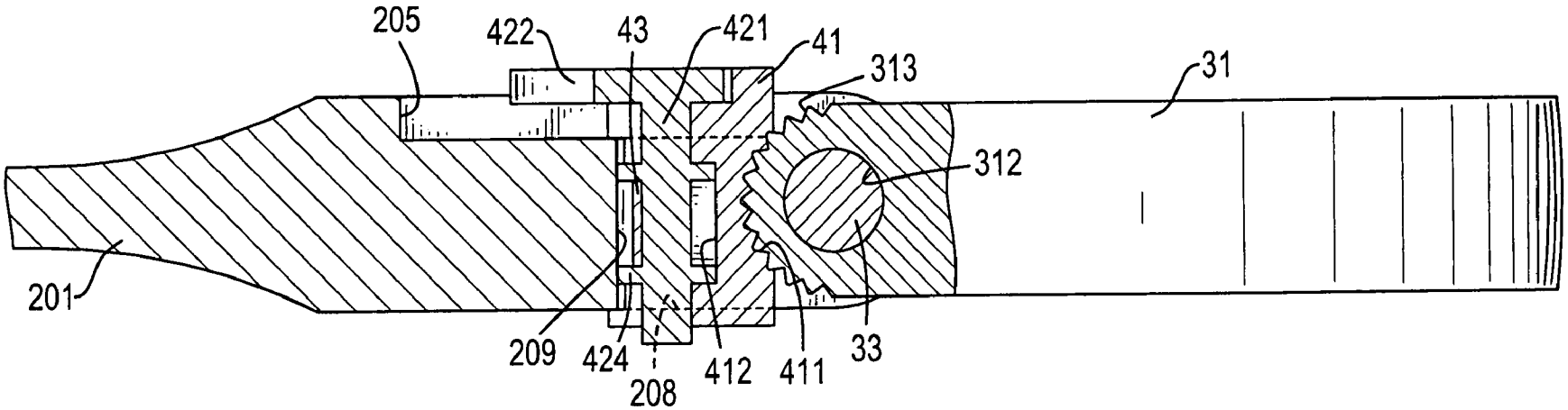
FIG. 2 is a side elevational view in partial section of the hand tool in FIG.
Figure 3:
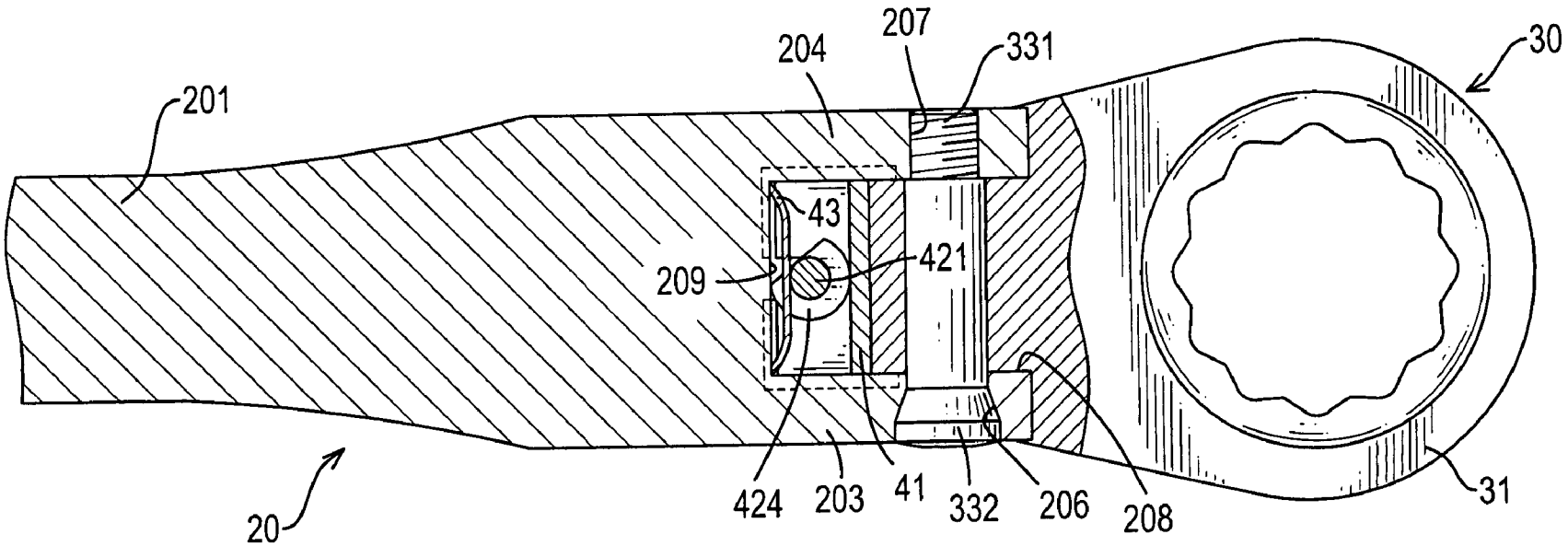
FIG. 3 is a top plan view in partial section of the hand tool in FIG. 1.

With reference to FIGS. 1, 2 and 3, a hand tool, such as a ratchet wrench (10) in accordance with the present invention comprises a handle (20), a head (30) and a head locking assembly (40).

The handle (20) has a grip (201), a distal end and a proximal end (202). The distal end of the handle (20) has an elongated slot (208) and a guiding groove (205). The elongated slot (208) is defined longitudinally at the distal end and forms two parallel pivot arms, a first pivot arm (203) and a second pivot arm (204). The elongated slot (208) has a bottom (209).

The guiding groove (205) is defined at the distal end of the handle (20) along the pivot arms (203, 204). The first pivot arm (203) has a through hole (206). The second pivot arm (204) has a threaded hole (207). The threaded hole (207) is aligned with the through hole (206). The proximal end (202) of the handle (20) can be an open end to drive fasteners.

The head (30) is adjustably mounted between the pivot arms (203, 204) and comprises a body (31), a ratchet drive (32) and a pivot pin (33). The body (31) has a pivot junction (311). The pivot junction (311) is pivotally mounted in the elongated slot (208) between the pivot arms (203, 204) and has a transverse hole (312) and an exterior toothed surface (313). The transverse hole (312) is defined completely through the pivot junction (311) and is aligned with both the through hole (206) and the threaded hole (207) for receiving the pivot pin (33).

The ratchet drive (32) may have a conventional configuration and is mounted in the body (31) to drive fasteners, such as nuts or bolts.

The pivot pin (33) is held in the aligned holes (206, 312, 207) and has an exterior thread (331) and an enlarged head (332). The exterior thread (331) extends into the through hole (206) and the transverse hole (312) and screws into the threaded hole (207) to pivotally mount the body (31) of the head (30) on the handle (20). Consequently, the head (30) can be adjusted to a given angle relative to the handle (20).

The head locking assembly (40) positions and locks the head (30) to maintain the head (30) at the given angle after the head (30) is adjusted. The head locking assembly (40) comprises a sliding block (41), a rotatable locking assembly (42) and a block biasing assembly (43).

The sliding block (41) is slidably mounted in the elongated slot (208) between the pivot junction (311) of the body (31) and the bottom (209) of the elongated slot (208) and slides along the guiding groove (205). The sliding block (41) comprises an engaging device (411) and has an inner space (412) facing the bottom (209) of the elongated slot (208). The engaging device (411) is formed corresponding to the exterior toothed surface (313) of the body (31) and can be a toothed surface to engage firmly the exterior toothed surface (313).

The rotatable locking assembly (42) is rotatably mounted in the sliding block (41) and comprises a spindle (421), a turning leaf (422) and a locking device (423). The spindle (421) is rotatably mounted in the sliding block (41) and has two opposite ends. The turning leaf (422) is attached to the spindle (421) at one of the ends over the sliding block (41) to rotate the spindle (421). The locking device (423) is attached to the spindle (421) in the inner space (412) of the sliding block (41) and comprises two parallel cams (424).

The block biasing assembly (43) can be a leaf spring and is mounted on the bottom (209) of the elongated slot (208) between the cams (424). The leaf spring abuts the spindle (421) and is compressed by the spindle (421) to produce a restitution force. The restitution force in the leaf spring pushes the sliding block (41) toward the exterior toothed surface (313) of the body (31) whereby the engaging device (411) of the sliding block (41) will normally contact with the exterior toothed surface (313) of the body (31). The engagement between the engaging device (411) and the exterior toothed surface (313) positions the head (30) at a given angular position relative to the handle (20) before the head (30) is locked.

A person can lock the head (30) at the angular position relative to the handle (20) by using only a single hand. The person can use four fingers to hold the grip (201) of the handle (20) and the corresponding thumb to turn the turning leaf (422) to rotate the spindle (421). The rotated spindle (421) will change the angular positions of the cams (424) until the cams (424) abut on the bottom (209) of the elongated slot (208). The engaged cams (424) restrict the sliding block (41) in motion so that the engaging device (411) will engage firmly the exterior toothed surface (313) of the body (31) to lock the head (30) at the given position relative to the handle (20).

Figure 4:
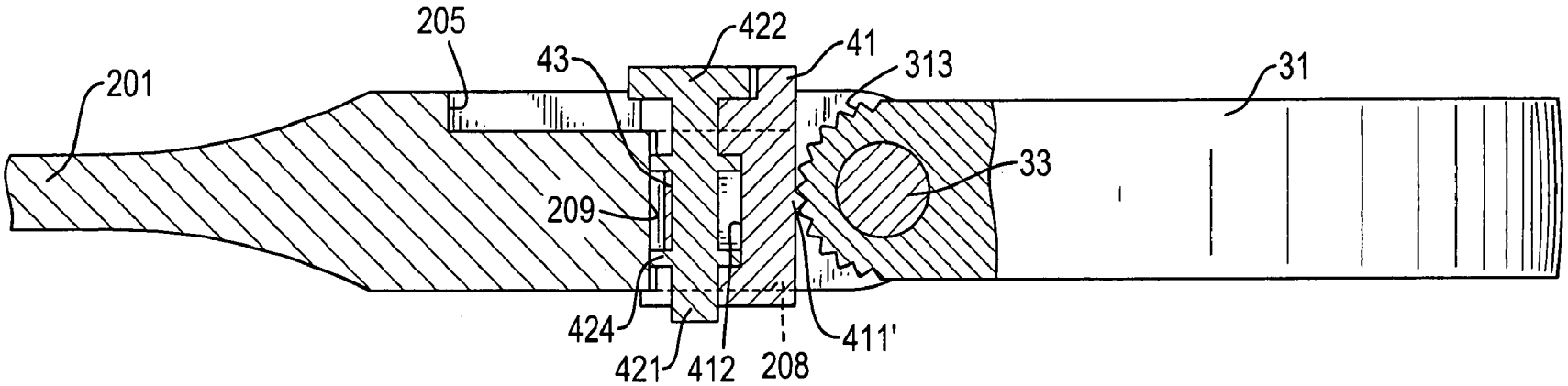
FIG. 4 is a side elevational view in partial section of a second embodiment of the hand tool in FIG. 1.

With reference to FIG. 4, a second embodiment of the present invention is a modification of the first embodiment and the modification is implemented with a modified engaging device (411'). The engaging device (411') comprises a single transverse tooth to engage the exterior toothed surface (313) of the body (31) to position the head (30) and locks the head (30) while the cams (424) abut the bottom (209) of the elongated slot (208).

Figure 5:
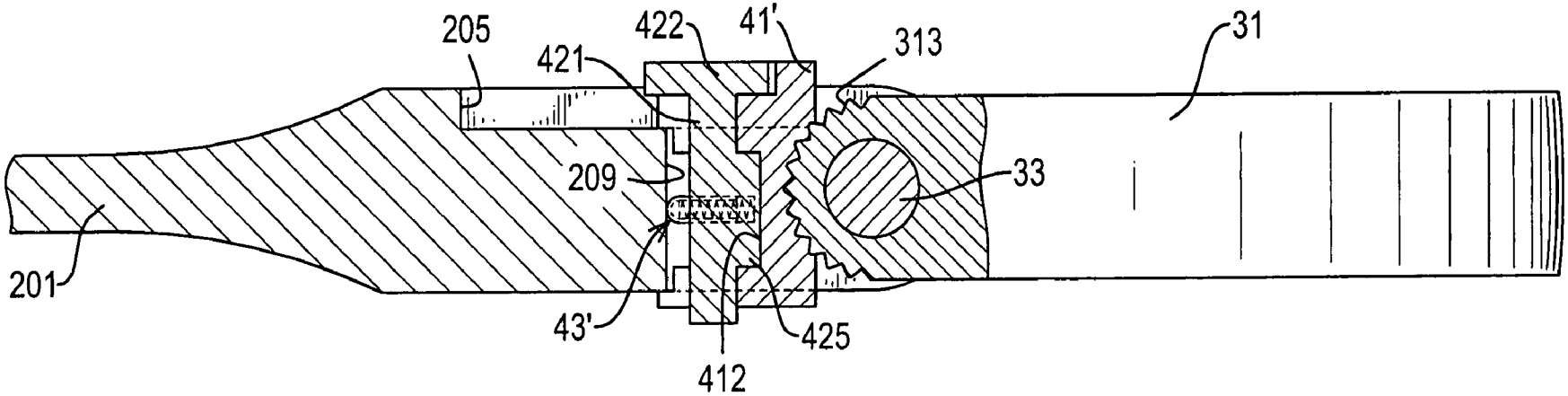
FIG. 5 is a side elevational view in partial section of a third embodiment of the hand tool in FIG. 1.
Figure 6:
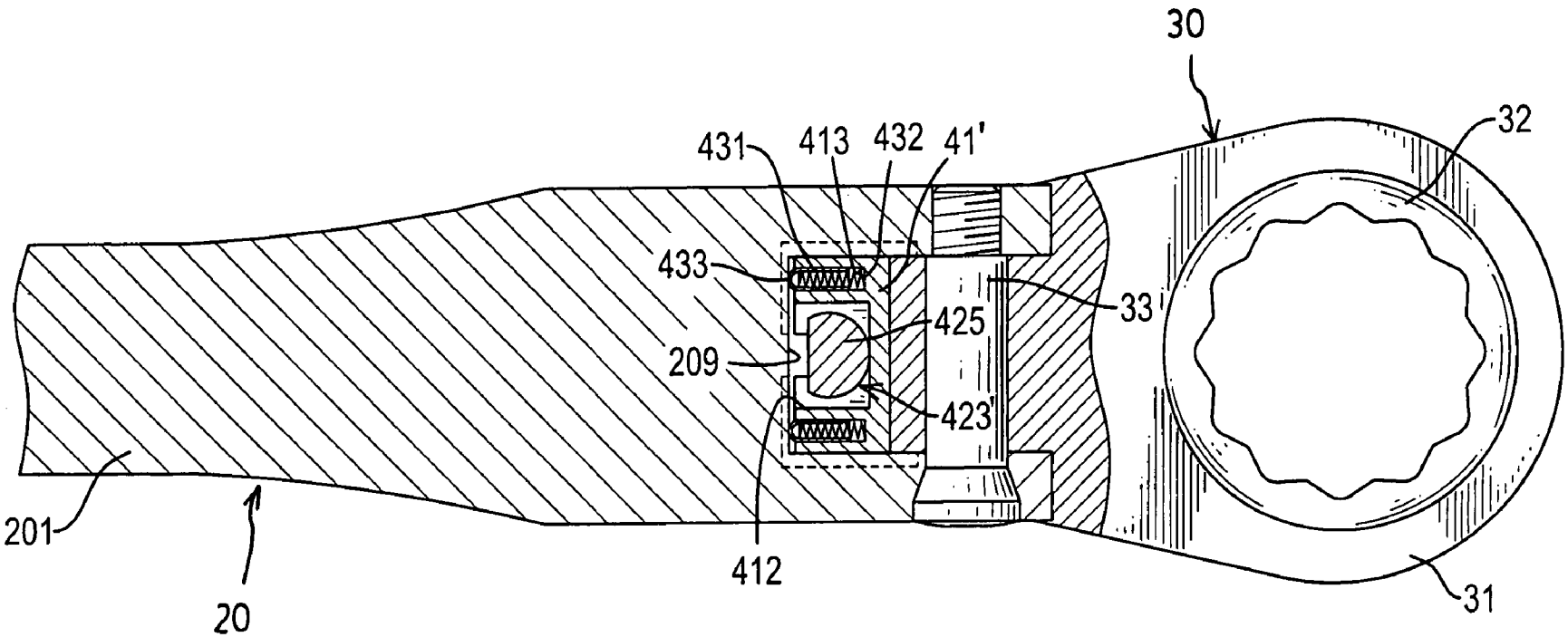
FIG. 6 is a top plan view in partial section of the third embodiment of the hand tool in FIG. 5.

With reference to FIGS. 5 and 6, a third embodiment of the present invention is a modification of the first embodiment and the modification is implemented with a modified block biasing assembly (43'), a modified locking device (423') and a modified sliding block (41'). The block biasing assembly (43') comprises two hollow pins (431) and two resilient elements (432). The sliding block (41') further has two spring holes (413) that face the bottom (209) of the elongated slot (208). The locking device (423') is implemented with a cam block (425). The cam block (425) is mounted on the spindle (421) in the inner space (412) in the sliding block (41).

The resilient elements (432) are respectively mounted in the spring holes (413) in the sliding block (41) and may be springs. The hollow pins (431) are respectively mounted around the resilient elements (432) in the spring holes (413), and each of the hollow pins (431) has an outside end (433). The outside ends (433) of the hollow pins (431) abut the bottom (209) of the elongated slot (208). Therefore, the hollow pins (431) cooperate with the resilient elements (431) to push the sliding block (41) toward the exterior toothed surface (313) of the body (31) to position the head (30) at a given angular position relative to the handle (20) as previously described.

Figure 7:
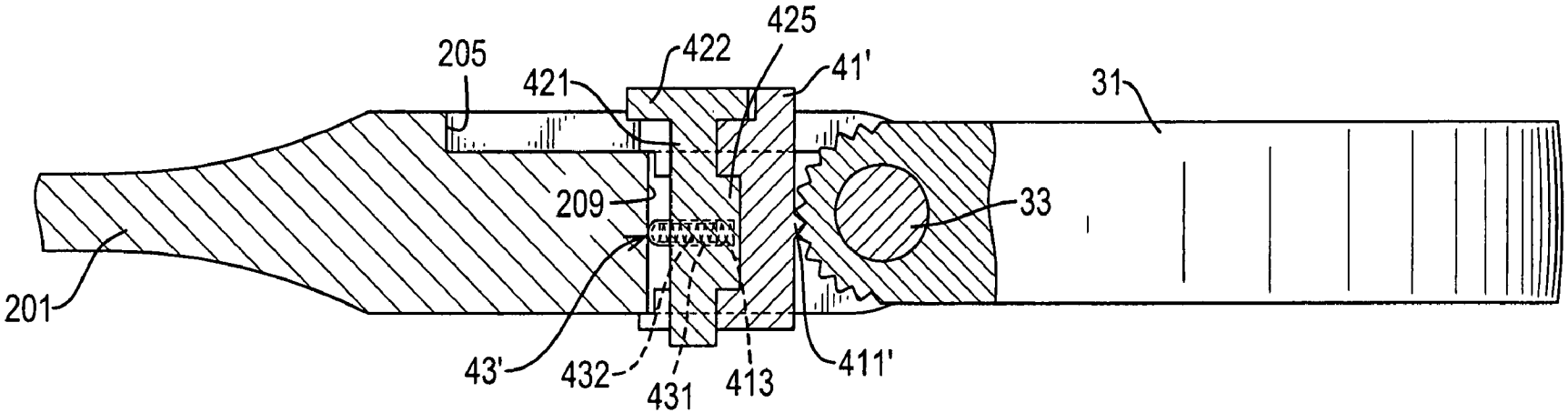
FIG. 7 is a side elevational view in partial section of a fourth embodiment of the hand tool in FIG. 1.

With reference to FIG. 7, a fourth embodiment of the present invention modifies the third embodiment and implements the modification with the modified engaging device (411') of the second embodiment. Since the descriptions of the functions and operations of the engaging device (411') are provided in the aforesaid embodiments, a detailed description of the fourth embodiment is not provided.

Figure 8:
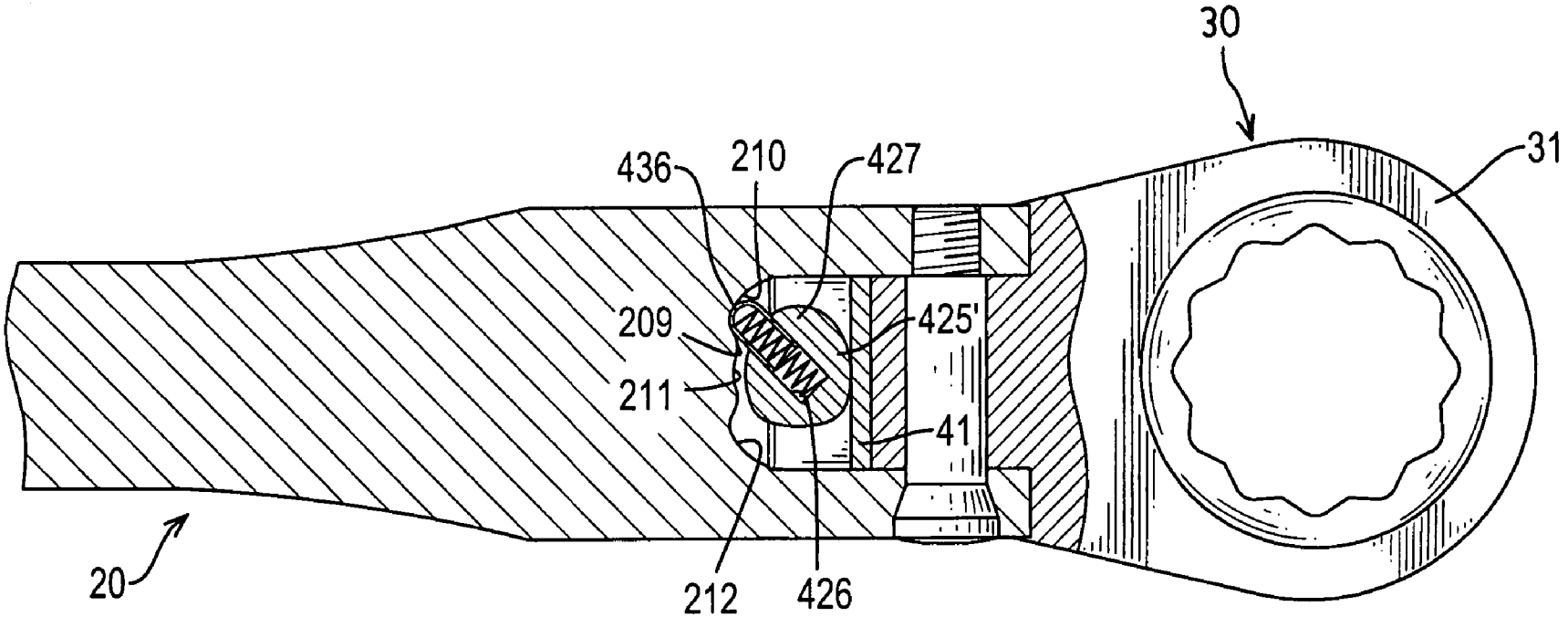
FIG. 8 is a top plan view in partial section of a fifth embodiment of the hand tool in FIG. 1.
Figure 9:
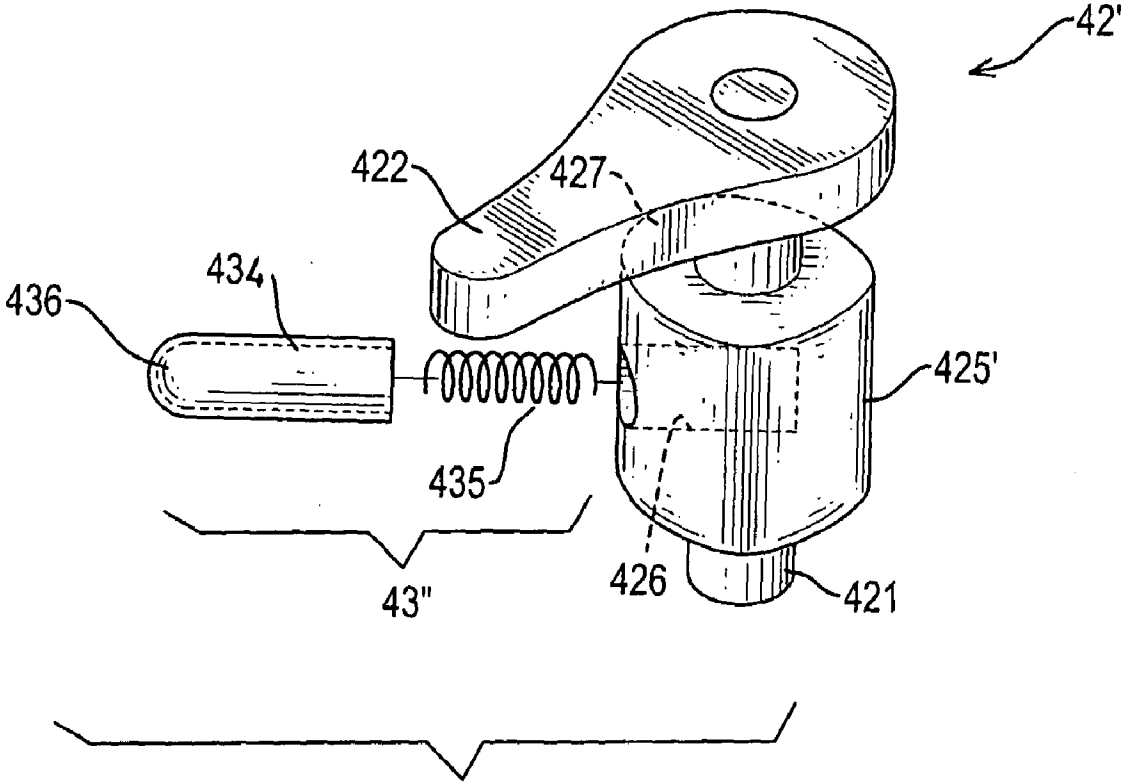
FIG. 9 is an exploded perspective view of a rotatable locking assembly of the fifth embodiment of the hand tool in FIG. 8.
Figure 10:
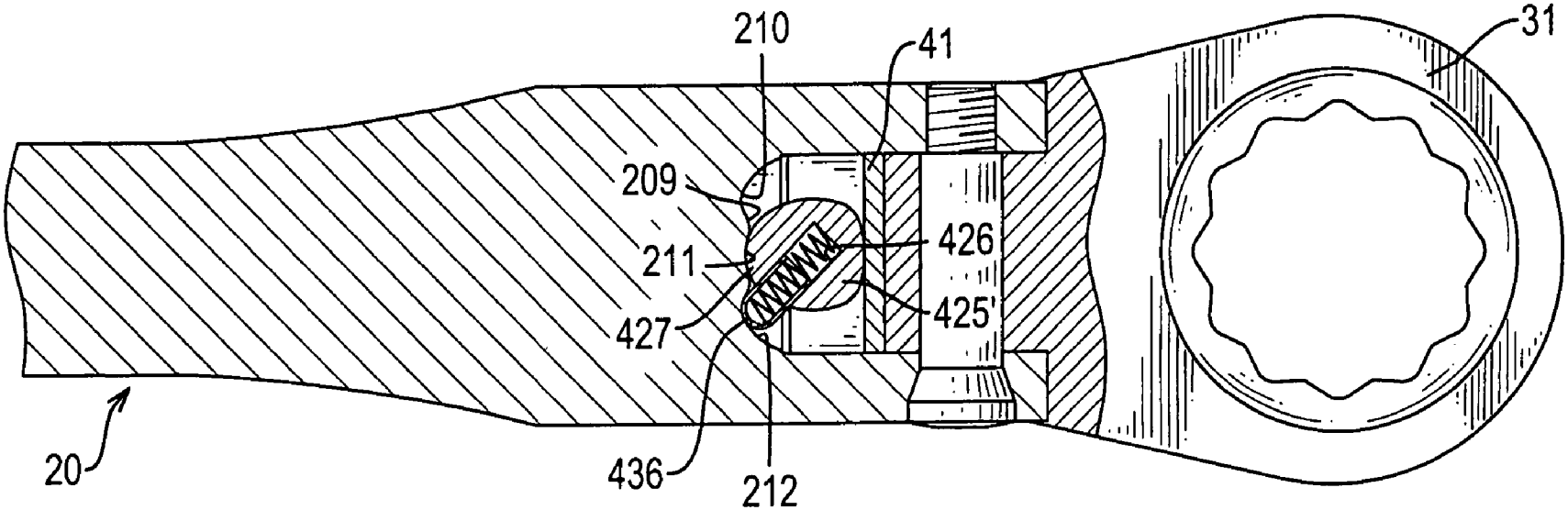
FIG. 10 is an operational top plan view in partial section of the fifth embodiment of the hand tool in FIG. 8.
Figure 11:
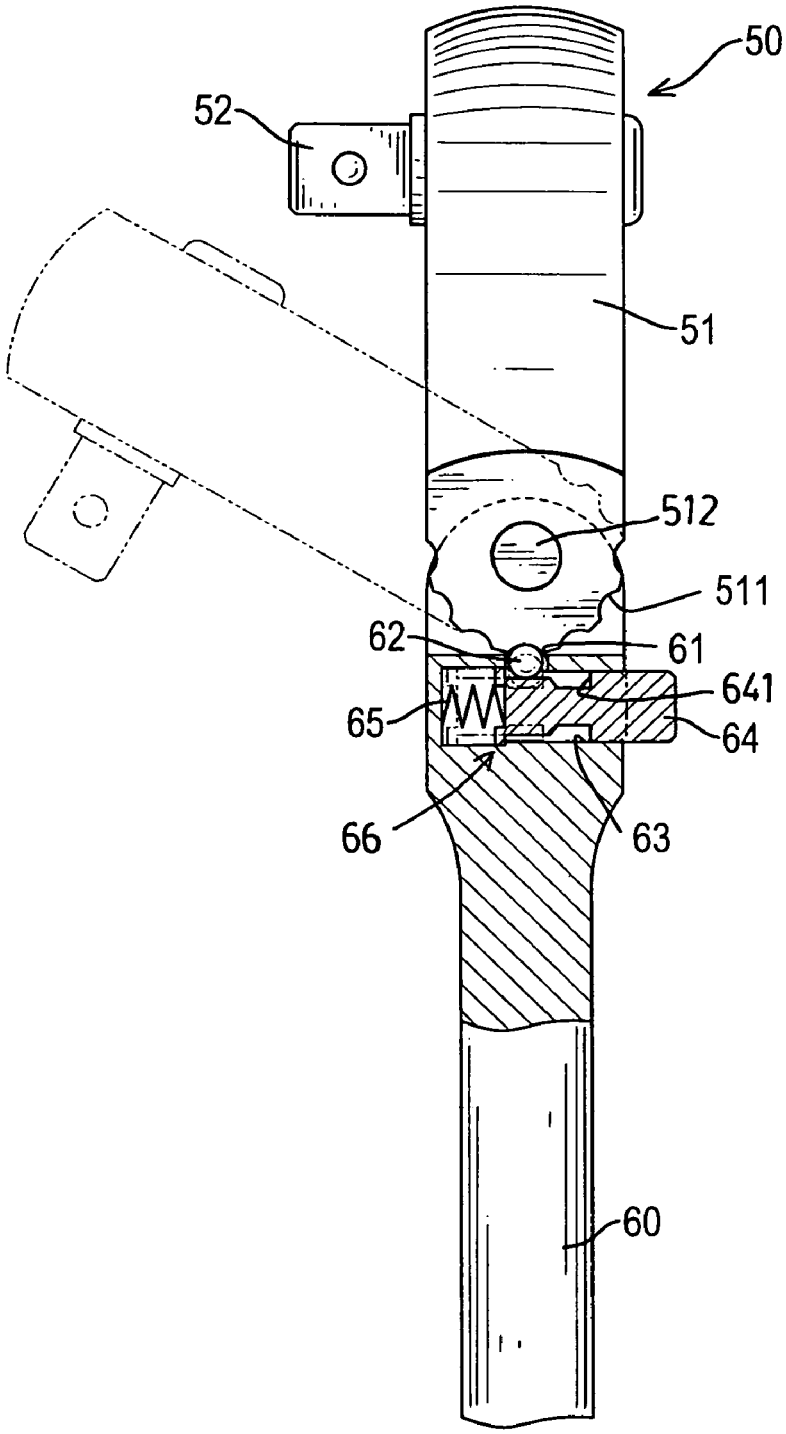
FIG.11 PRIOR ART
FIG. 11 is an operational elevational view in partial section of a conventional ratchet hand tool in accordance with the prior art.

With reference to FIGS. 8, 9 and 10, a fifth embodiment of the present invention is an alternative modification of the first embodiment and the modification is implemented with a modified rotatable locking assembly (42') and a modified block biasing assembly (43"). The bottom (209) of the elongated slot (208) further has three detents: a first detent (210), a second detent (211) and a third detent (212). The second detent (211) is defined between the other two detents (210, 212).

The rotatable locking assembly (42') comprises a spindle (421), a turning leaf (422) and a locking device such as an eccentric cam block (425'). The spindle (421) is rotatably mounted in the sliding block (41) and has two opposite ends. The turning leaf (422) is attached to the spindle (421) at one of the ends to rotate the spindle (421) as the turning leaf (422) is turned by a single hand.

The cam block (425') is mounted on the spindle (421) in the sliding block (41) and has an eccentric portion (427) and a spring hole (426). The eccentric portion (427) will engage the second detent (211) to lock the sliding block (41) by turning the turning leaf (422). The spring hole (426) in the cam block (425') is selectively aligned with the first and the third detents (210, 212) as the cam block (425') is rotated.

The block biasing assembly (43") is mounted in the spring hole (426) in the cam block (425') and comprises a hollow pin (434) and a resilient element (435). The resilient element (435) is mounted and held in the spring hole (426) and may be a spring. The hollow pin (434) is mounted around the resilient element (435), is held in the spring hole (426) and has an outside end (436) extending out of the spring hole (426). The outside end (436) engages selectively the first and the third detents (210, 212).

When the outside end (436) engages the first detent (210), which compresses the resilient element (435) to produce a restitution force, the restitution force pushes the sliding block (41) to position the head (30). Turning the turning leaf (422) will change the angular position of the eccentric portion (427) of the cam block (425') through the spindle (421) until the eccentric portion (427) engages the second detent (211) and the outside end (436) of the hollow pin (436) is received in the third detent (212). The sliding block (41) will be blocked in motion to lock the head (30) as the eccentric portion (427) engages the second detent (211).

Consequently, operating the hand tool in accordance with the present invention to lock or unlock the head (30) can be completed with only a single hand by turning the turning leaf (422) and is really convenient. The head (30) can be directly adjusted without turning the turning leaf (422) during a period of adjustment and be locked by simply using the thumb to turn the turning leaf (422) after the adjustment is completed.

The present invention utilizes the engaging device (411, 411') that may be a single tooth or a toothed surface to mesh with the exterior toothed surface (313) of the body (31) to efficiently lock the head (30) at the given angular position relative to the handle (20). The effective locking between the head (30) and the sliding block (41) will prevent the hand tool from slipping out from a hand using the hand tool to tighten or loosen the fasteners.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the scope of the appended claims.

What is claimed is:

1. A hand tool having an adjustable head, and the hand tool comprising:

a handle having a distal end and an elongated slot with a bottom defined at the distal end and forming a first pivot arm and a second pivot arm at the distal end;

a head adjustably mounted at the distal end of the handle and having a body pivotally mounted at the distal end and having a pivot junction pivotally mounted in the elongated slot between the first and the second pivot arms and having an exterior toothed surface corresponding to the bottom of the elongated slot; and a head locking assembly to position and lock the head at a given angular position relative to the handle and the head locking assembly comprising a sliding block slidably mounted in the elongated slot between the pivot junction of the body and the bottom of the elongated slot and comprising an engaging device to engage the exterior toothed surface of the pivot junction;

a rotatable locking assembly rotatably mounted in the sliding block and comprising a spindle rotatably mounted in the sliding block, a turning leaf attached to the spindle to rotate the spindle and a locking device attached to the spindle; and a block biasing assembly mounted in the elongated slot between the sliding block and the bottom of the elongated slot;

whereby turning the turning leaf until the locking device abuts the bottom of the elongated slot restricts the sliding block in motion and lock the head at the given angular position.

2. The hand tool having an adjustable head as claimed in claim 1, wherein the handle further has a grip and a guiding groove defined at the distal end of the handle along the first and the second pivot arms;

the first pivot arm has a through hole;

the second pivot arm has a threaded hole aligned with the through hole;

the pivot junction of the head further has a transverse hole defined completely through the pivot junction and aligned with both the through hole and the threaded hole; and the head further comprises a ratchet drive mounted in the body to drive fasteners; and a pivot pin held in the aligned through hole, transverse hole and threaded hole and having an enlarged head and an exterior thread extending into the through hole and the transverse hole and screwing into the threaded hole.

3. The hand tool having an adjustable head as claimed in claim 2, wherein the sliding block is slidably mounted along the guiding groove and further has an inner space;

the locking device comprises two parallel cams attached to the spindle in the inner space of the sliding block; and the block biasing assembly comprises a leaf spring mounted on the bottom of the elongated slot between the cams and compressed by the spindle.

4. The hand tool having an adjustable head as claimed in claim 2, wherein the sliding block is slidably mounted along the guiding groove and further has an inner space and two spring holes that face the bottom of the elongated slot;

the locking device comprises a cam block mounted on the spindle in the inner space in the sliding block; and the block biasing assembly comprises two resilient elements respectively mounted in the spring holes in the sliding block and two hollow pins respectively mounted around the resilient elements in the spring holes, and each of the hollow pins has an outside end abutting the bottom of the elongated slot.

5. The hand tool having an adjustable head as claimed in claim 2, wherein the sliding block is slidably mounted along the guiding groove and further has an inner space;

the bottom of the elongated slot further has a first detent, a second detent and a third detent wherein the second detent is defined between the first and the third detents;

the locking device comprises a cam block mounted on the spindle in sliding block and having an eccentric portion engaging the second detent to lock the sliding block and a spring hole selectively aligned with the first and the third detents; and the block biasing assembly is mounted in the spring hole in the cam block and comprises a resilient element mounted and held in the spring hole in the cam block and a hollow pin mounted around the resilient element, held in the spring hole and having an outside end extending out of the spring hole to engage selectively the first and the third detents.

6. The hand tool having an adjustable head as claimed in claim 4, wherein the resilient elements are springs.

7. The hand tool having an adjustable head as claimed in claim 5, wherein the resilient element is a spring.

8. The hand tool having an adjustable head as claimed in claim 1, wherein the engaging device on the sliding block is a toothed surface.

9. The hand tool having an adjustable head as claimed in claim 3, wherein the engaging device on the sliding block is a toothed surface.

10. The hand tool having an adjustable head as claimed in claim 4, wherein the engaging device on the sliding block is a toothed surface.

11. The hand tool having an adjustable head as claimed in claim 5, wherein the engaging device on the sliding block is a toothed surface.

12. The hand tool having an adjustable head as claimed in claim 1, wherein the engaging device on the sliding block is a single transverse tooth.

13. The hand tool having an adjustable head as claimed in claim 3, wherein the engaging device on the sliding block is a single transverse tooth.

14. The hand tool having an adjustable head as claimed in claim 4, wherein the engaging device on the sliding block is a single transverse tooth.

15. The hand tool having an adjustable head as claimed in claim 5, wherein the engaging device on the sliding block is a single transverse tooth.

* * * * *